US006678982B2

(12) United States Patent
Pitcher et al.

(10) Patent No.: US 6,678,982 B2
(45) Date of Patent: Jan. 20, 2004

(54) EXTRUDED GRIP ASSEMBLY WITH SPRING

(75) Inventors: David E. Pitcher, Cambridge, MA (US); Thomas P. Burrows, Andover, MA (US)

(73) Assignee: Rose Displays Ltd., Salem, MA (US)

( * ) Notice: Subject to any disclaimer, the term of this patent is extended or adjusted under 35 U.S.C. 154(b) by 199 days.

(21) Appl. No.: 09/820,069

(22) Filed: Mar. 28, 2001

(65) Prior Publication Data

US 2002/0139025 A1 Oct. 3, 2002

(51) Int. Cl.[7] ..... A47G 1/06
(52) U.S. Cl. ..... 40/793
(58) Field of Search ..... 40/590, 611, 790, 40/791, 792, 793

(56) References Cited

U.S. PATENT DOCUMENTS

| | | | | | |
|---|---|---|---|---|---|
| 3,310,901 | A | * | 3/1967 | Sarkisian | 40/793 |
| 4,512,094 | A | * | 4/1985 | Seely | 40/793 |
| 4,519,152 | A | | 5/1985 | Seely et al. | |
| 4,580,361 | A | | 4/1986 | Hillstrom et al. | |
| 4,756,107 | A | * | 7/1988 | Hillstrom | 40/793 |
| 4,937,959 | A | | 7/1990 | Palmer et al. | |
| 4,958,458 | A | * | 9/1990 | Hillstrom et al. | 40/793 |
| 5,608,980 | A | * | 3/1997 | Pangerl | 40/793 |
| 5,732,496 | A | | 3/1998 | Tanaka | |
| 5,815,971 | A | * | 10/1998 | Rothe et al. | 40/793 |
| 5,930,928 | A | * | 8/1999 | Kantola et al. | 40/793 |

* cited by examiner

*Primary Examiner*—S. Joseph Morano
*Assistant Examiner*—Andrew Wright
(74) *Attorney, Agent, or Firm*—Don Halgren

(57) ABSTRACT

A multiple component gripper extrusion for the gripping support of a poster display arrangement. The gripped extrusion comprises an elongated extruded back panel having a front face, a back face, a lower edge and an upper edge. An elongated extruded front panel with a panel leg at a proximal portion thereof and a channel at a distal edge thereof is arranged with the back panel. The front panel is integrally connected by a living hinge co-extruded simultaneously therewith. An elongated spring is adjustably disposed between the back panel and the distal edge of the front panel to permit controllable biasing of a poster supported on the back panel by the front panel.

8 Claims, 6 Drawing Sheets

EXTRUDED GRIP ASSEMBLY WITH SPRING

BACKGROUND OF THE INVENTION

1. Field of the Invention

This invention relates to extruded elongated grip members for gripping and displaying sheet material such as posters or the like, which posters or the like are readily changeable as desired.

2. Prior Art

Poster gripping assemblies have been known in the field, for a number of years. One such instance is shown in U.S. Pat. No. 4,519,152 to Seely et. al. which shows a tamper proof poster display arrangement. This display arrangement has an outer cover portion with certain defined angles which make it difficult to open the cover from its base. An "opener tool" is required for that. The cover and the base portions are independently extruded and have a hinge relationship which requires a difficult "slide together" assembly. U.S. Pat. No. 4,937,959 to Palmer et. al. discloses a gripper extrusion arrangement wherein a front cover portion and a rear panel portion are separately extruded and mated together in another complicated hinge assembly. Inadvertent sliding between the front cover portion and the rear panel portion is prevented by a rather complicated discontinuity formed in the front panel which mates with a slot or the like in the rear panel. This requires further operations and unnecessary manufacturing costs. U.S. Pat. No. 5,307,575 to Ivansson et. al. shows a frame corner assembly wherein adjacent sides of a frame are held together with a rather complicated bracket arrangement. The cover portions and rear panel portions are individually extruded and are snapped together. Alignment of the ends of these multiple component arrangements lead to inaccurate end mis-aligned corner sections. U.S. Pat. No. 5,732,496 to Tanaka shows a sign frame with corner arrangements for attaching sides of that frame together. Mitered alignment of the corners is avoided by a corner insert which is somewhat more expensive to manufacture and adds a further step in that procedure.

It is an object of the present invention, to provide a poster gripping assembly which overcomes the disadvantages of the prior art.

It is a further object of the present invention to provide a poster gripping assembly which may be utilized in a poster-holding configuration by itself or in a frame construction of rectilinear configuration.

It is a further object of the present invention to provide a poster gripping assembly which simplifies the manufacturing operation over the prior art.

It is another object of the present invention to provide a poster gripping apparatus with a biasing spring arrangement which may be readily adjusted and re-conformed to permit adjustment of its bias.

It is yet still a further object of the present invention to provide a poster gripping assembly which may be assembled into a rectilinear frame construction with accuracy and simplicity while minimizing the likelihood of defects as may be associated with the prior art.

BRIEF SUMMARY OF THE INVENTION

The present invention comprises an elongated multiple component extrusion for the ready insertion and removal of a display poster therefrom. The elongated extrusion comprises an elongated back panel unitarily co-extruded with a front cover panel articulably connected thereto by a living hinge arranged connectively therebetween. The back panel has a forwardly directed face, a rearwardly directed or back face and a lowermost end. A rearwardly directed lower flange extends off of the lowermost edge of the rearward face of the elongated back panel. A middle flange, of "L"-shape in cross section, extends off of a midpoint of the back face of the elongated back panel.

An upper flange extends off of the back face of the upper end of the elongated back panel, having a lip thereof directed in opposition to the lip of the middle flange. The upper flange and the middle flange thereby defining a pair of opposed channels for sliding receipt of a securement means or a corner bracket therebetween.

A panel leg connects one edge of the living hinge to the proximal portion of the front cover panel. The panel leg and the front cover panel meet at an angle of about 90 degrees at a corner juncture therebetween. An elongated proximal lip is arranged at the juncture of the living hinge and the panel leg and is disposed at an angle of about 90 degrees with respect to the proximal end of that panel leg.

A frontwardly directed front web or bridge extends from the upper edge of the forwardly directed face of the elongated back panel in coextensive alignment with the leg of the upper flange thereof. An elongated, rearwardly directed "L"-shaped support flange is arranged at the distal end of the front web or bridge to define a channel which receives the proximal lip extending from the lower end of the panel leg. The front end or bridge also has a channel flange extending downwardly therefrom, parallel to the forward face of the elongated back panel.

A generally forwardly directed "C"-shaped receiving channel is co-extruded on the distal edge of that channel flange. The "C"-shaped receiving channel is defined by an arcuate segment of about 90 degrees, having a pair of linear first and second lips arranged perpendicularly with respect to one another. The first and second lips are spaced-apart at their distalmost edges to define a linear opening therebetween.

The front cover panel has a distalmost edge with a rearwardly directed flange extending therefrom. The rearwardly directed flange and the distalmost edge portion of the front cover panel define a "V"-shaped channel therebetween in cross-section. The rearwardly directed flange has an elongated distal foot co-extruded therewith. The distal foot is a linear extension, disposed generally perpendicularly to the plane defined by the front cover panel at its distalmost edge portion.

One or more shapable, elongated, generally sinusoidally-shaped wire-like springs are disposed between the elongated back panel and the elongated front cover panel. The elongated springs each have end portions which are generally parallel with one another. A first end portion of the elongated spring may be inserted within the generally "C"-shaped receiving channel facing forwardly from the elongated back panel. The elongated spring has a second end which may mate within the "V"-shaped channel formed at the rearward side of the distal end of the front cover panel.

In the fabrication of a frame assembly from the extruded back panel and front cover panel, each end thereof would be mitered into a 45 degree cut. Each mitered end would be then mated with a correspondingly mitered end of a further elongated back panel and elongated co-extruded front cover panel with an "L"-shaped bracket disposed at the juncture thereof lodged between the upwardly directed middle flange and the downwardly directed lip of the upper flange.

A backer board may be inserted within the receiving channel adjacent the uppermost edge of the forward face of each elongated back panel. A flexible poster may be disposed atop the backer board and the front cover panel pivoted downwardly about the support flange so that the spring biases the front cover panel and its distalmost foot therefrom, against the front surface of the poster on that backer board.

Thus has been shown a unique co-extruded poster gripping arrangement which may be assembled into a frame or utilized singularly to display a poster in an efficient and cost effective manner.

The invention thus comprises a multiple component gripper extrusion for the gripping support of a poster display arrangement, comprising: an elongated extruded back panel having a front face, a back face, a lower edge and an upper edge; an elongated extruded front panel with a panel leg at a proximal portion thereof and a channel at a distal edge thereof. The back panel and the front panel are integrally connected by a living hinge co-extruded simultaneously therewith. An elongated spring is adjustably disposed between the back panel and the distal edge of the front panel to permit controllable biasing of a poster supported on the back panel by the front panel. An upper flange and a middle flange are arranged on the back face of the back panel to permit a plurality of the gripper extrusions to be readily joined together by a bracket mated between corresponding upper and middle flanges of adjacent gripper extrusions. An elongated "C" shaped channel is arranged on a flange extending off of the front face of the back panel, to provide a long slot for the spring to be adjustably disposed therein. The channel at the distal edge of the front panel is of "V" shape in cross-section, with a linear edge attached thereto, comprising a distal foot for pressing against a poster place upon the back panel. The panel leg has a proximal lip extending therefrom, the proximal lip being arranged to engage and pivot about a support flange arranged adjacent the upper edge of the back panel, for securement of the front panel onto the back panel when the front panel is biased against the front panel. The spring may be formed from a wire. The wire of the spring may be shaped into a sinusoidal configuration. The wire spring has a first end and a second end, the first end and the second end being generally parallel to one another to permit their ready emplacement in the back panel and the front panel. The linear edge comprising the distal foot pressing against said back panel when the front panel is biased against a poster on the back panel permits the distal edge thereof to be spaced-apart from the poster to permit the distal edge to be readily lifted away from the poster to permit changing thereof.

The invention also comprises a method of manufacturing a multiple component gripper extrusion for the gripping support of a poster display arrangement, comprising the steps of: extruding an elongated back panel having a front face, a back face, a lower edge and an upper edge; co-extruding an elongated front panel with a panel leg at a proximal portion thereof and a channel at a distal edge thereof with the back panel, the front panel being integrally connected to the back panel by a living hinge co-extruded simultaneously therewith; and installing an elongated spring between the back panel and the distal edge of the front panel to permit controllable biasing by the front panel of a poster supported on the back panel. The method may include one or more of the steps of: forming the elongated spring from a wire; arranging the wire spring into a sinusoidal shape; bending the wire spring to effect a change in the biasing characteristics thereof. The method may also include the step of: forming a pair of flanges on the back face of the back panel to permit a bracket to be engaged therein, so as to permit the gripper extrusion to be joined with a further arrangement of gripper extrusions to form a rectilinear frame assembly.

BRIEF DESCRIPTION OF THE DRAWINGS

The objects and advantages of the present invention will become more apparent, when viewed in conjunction with the following drawings in which.

DESCRIPTION OF THE PREFERRED EMBODIMENT

Figure 1:
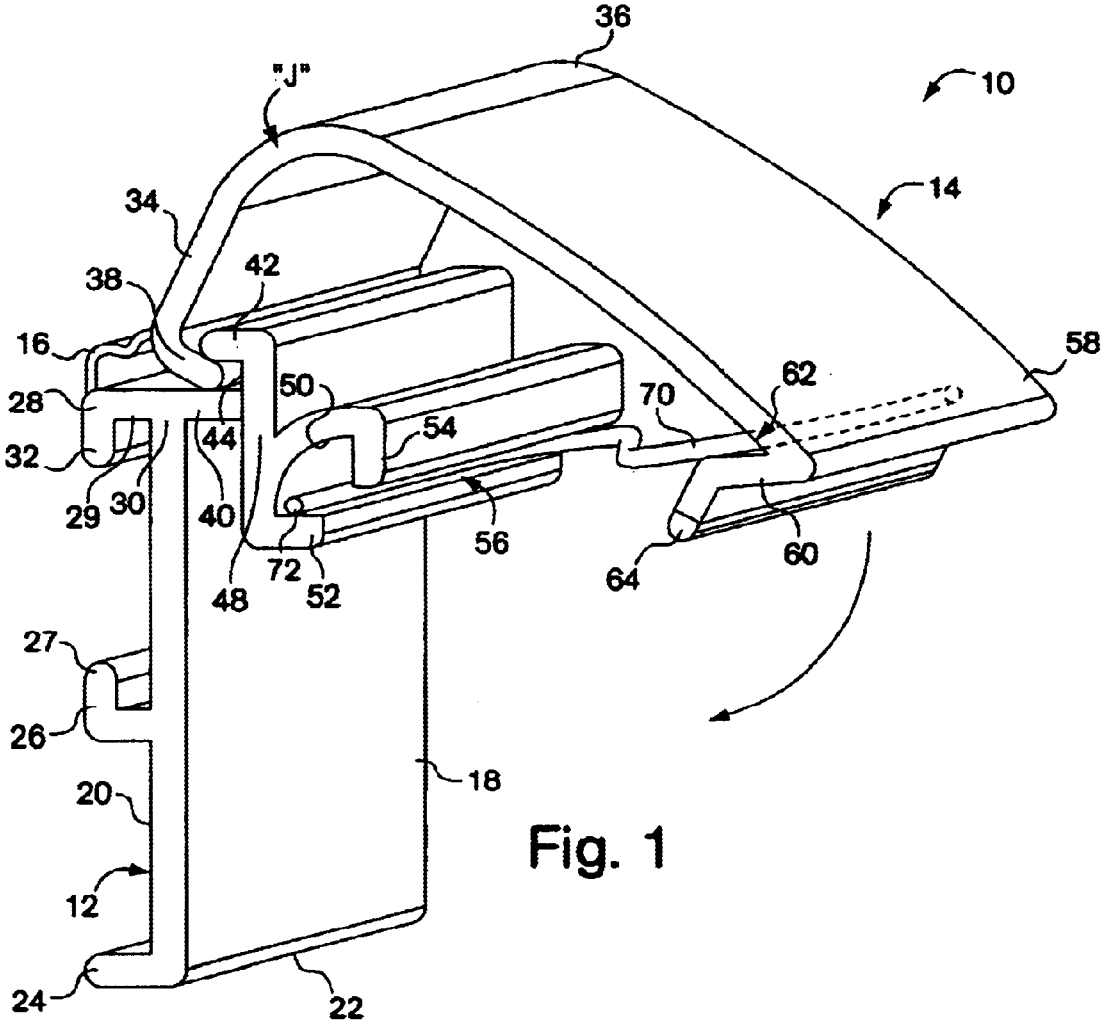
FIG. 1 is a perspective view of the clamp assembly constructed according to the principles of the present invention.
Figure 2:
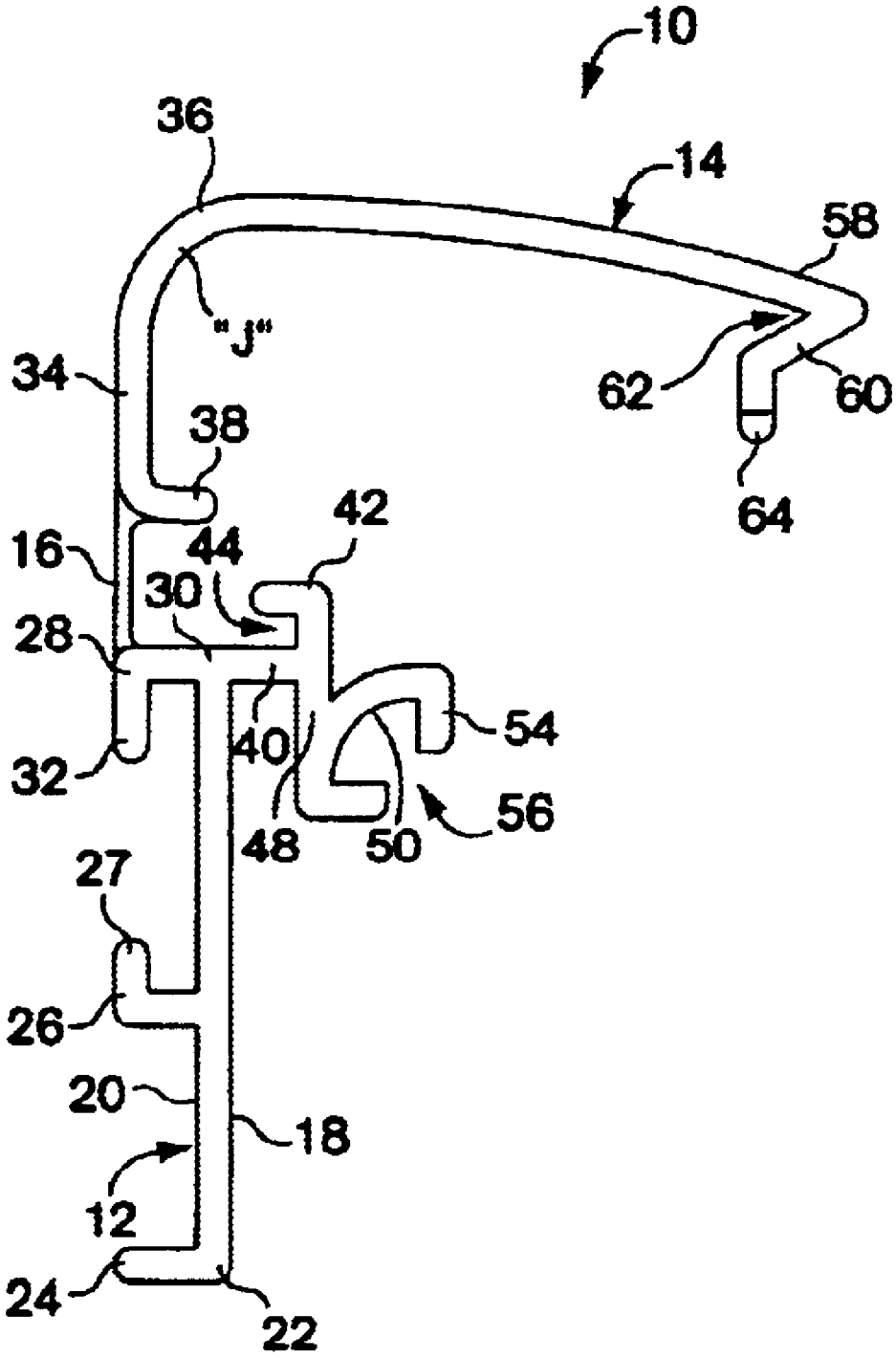
FIG. 2 is an end view of the back panel and front cover panel before assembly with a biasing means therewith.

Referring now to the drawings in detail, and particularly to FIG. 1, there is shown a short segment of the present invention which comprises an elongated multiple component gripper extrusion 10 for the ready insertion and removal of a display poster "P" therefrom. The elongated gripper extrusion 10 comprises an elongated back panel 12 unitarily co-extruded with a front cover panel 14 articulably connected thereto by a living hinge 16 arranged connectively therebetween. The back panel 12 has a forwardly directed face 18, a rearwardly directed or back face 20 and a lowermost end 22. A rearwardly directed lower flange 24 extends off of the lowermost edge 22 of the rearward face 20 of the elongated back panel 18. A middle flange 26, of "L"-shape in cross section, extends off of a midpoint of the back face of the elongated back panel, as may be seen in FIGS. 1–5.

An upper flange 28 extends off of the back face 20 of the upper end 30 of the elongated back panel 18, having a lip 32 thereof directed in opposition to the lip 27 of the middle flange 26. The upper flange 28 and the middle flange 26 thereby defining a pair of opposed channels for sliding receipt of a securement means or a corner bracket therebetween, as will be discussed hereinbelow.

A panel leg 34 connects one edge of the living hinge 16 to the proximal portion 36 of the front cover panel 14. The panel leg 34 and the front cover panel 14 meet at an angle of about 90 degrees at a corner juncture "J" therebetween. An elongated proximal lip 38 is arranged at the juncture of the living hinge 16 and the panel leg 34, and is disposed at an angle of about 90 degrees with respect to the proximal end of that panel leg 34.

A frontwardly directed front web or bridge 40 extends from the upper edge 30 of the forwardly directed face 18 of the elongated back panel 12 in co-extensive alignment with the leg portion 29 of the upper flange 28 thereof. An elongated, rearwardly directed "L"-shaped support flange 42 is arranged at the distal end of the front web or bridge 40 to define an edge channel 44 which receives the proximal lip 38 extending from the lower end of the panel leg 34. The front end or bridge 40 also has a channel flange 48 extending downwardly therefrom, parallel to the forward face 18 of the elongated back panel 12.

A generally forwardly directed "C"-shaped receiving channel 50 is co-extruded on the distal edge of that channel flange 48. The "C"-shaped receiving channel 50 is defined by an elongated, extruded arcuate-segment of about 90 degrees, having a pair of linear first and second lips 52 and 54 arranged perpendicularly with respect to one another, as may be seen in FIGS. 2, 3 and 4. The first and second lips 52 and 54 are spaced-apart at their distalmost edges to define a linear opening 56 therebetween.

The front cover panel 14 has a distalmost edge portion 58 with a rearwardly directed flange 60 extending therefrom. The rearwardly directed flange 60 and the distalmost edge portion 58 of the front cover panel 14 define a "V"-shaped channel 62 therebetween in cross-section. The rearwardly directed flange 60 has an elongated distal foot 64 co-extruded therewith. The distal foot 64 is a linear extension, disposed generally perpendicularly to the plane defined by the front cover panel 14 at its distalmost edge portion 58.

Figure 3:
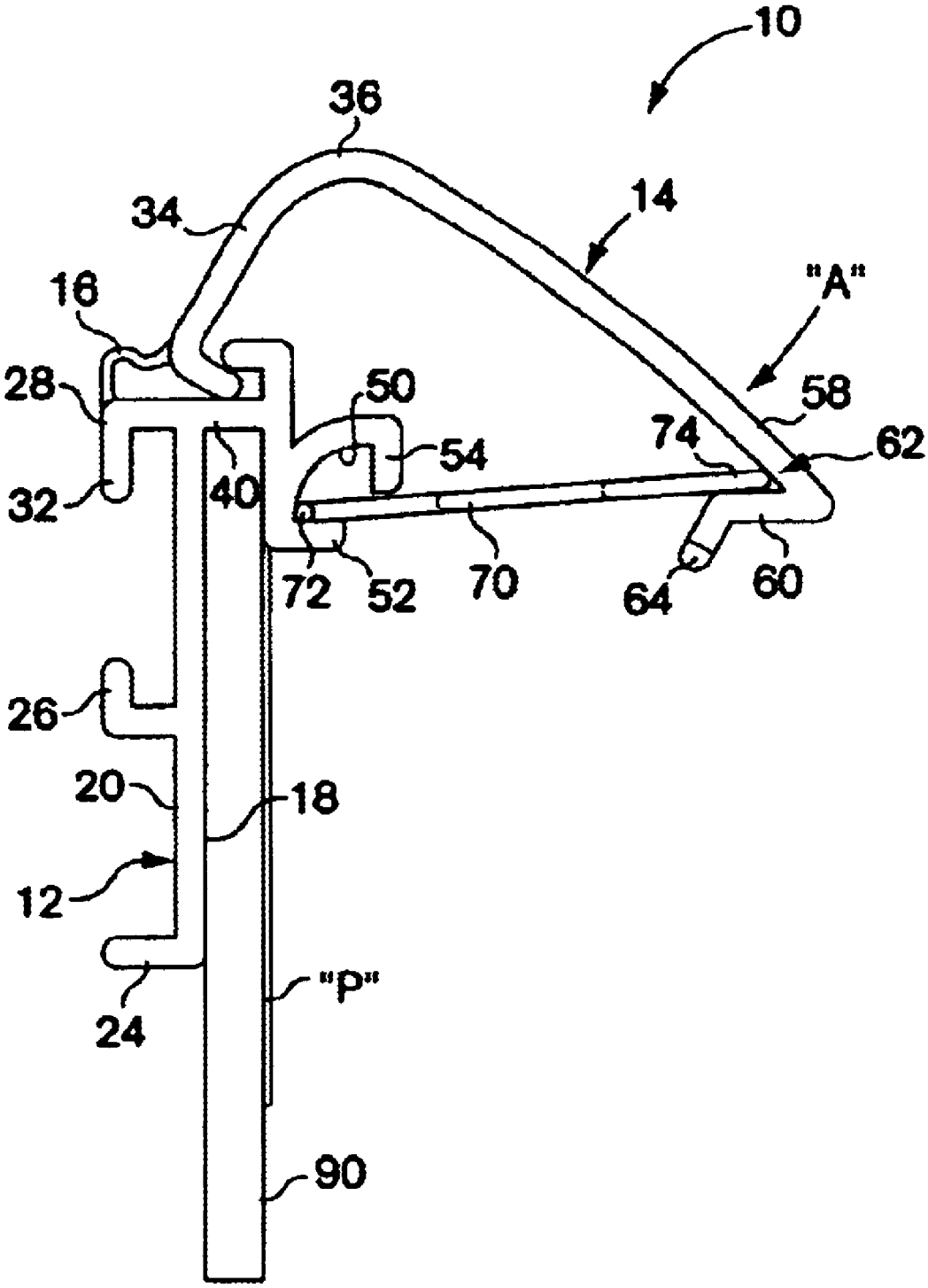
FIG. 3 is an end view of the gripping assembly shown in FIG. 1.
Figure 4:
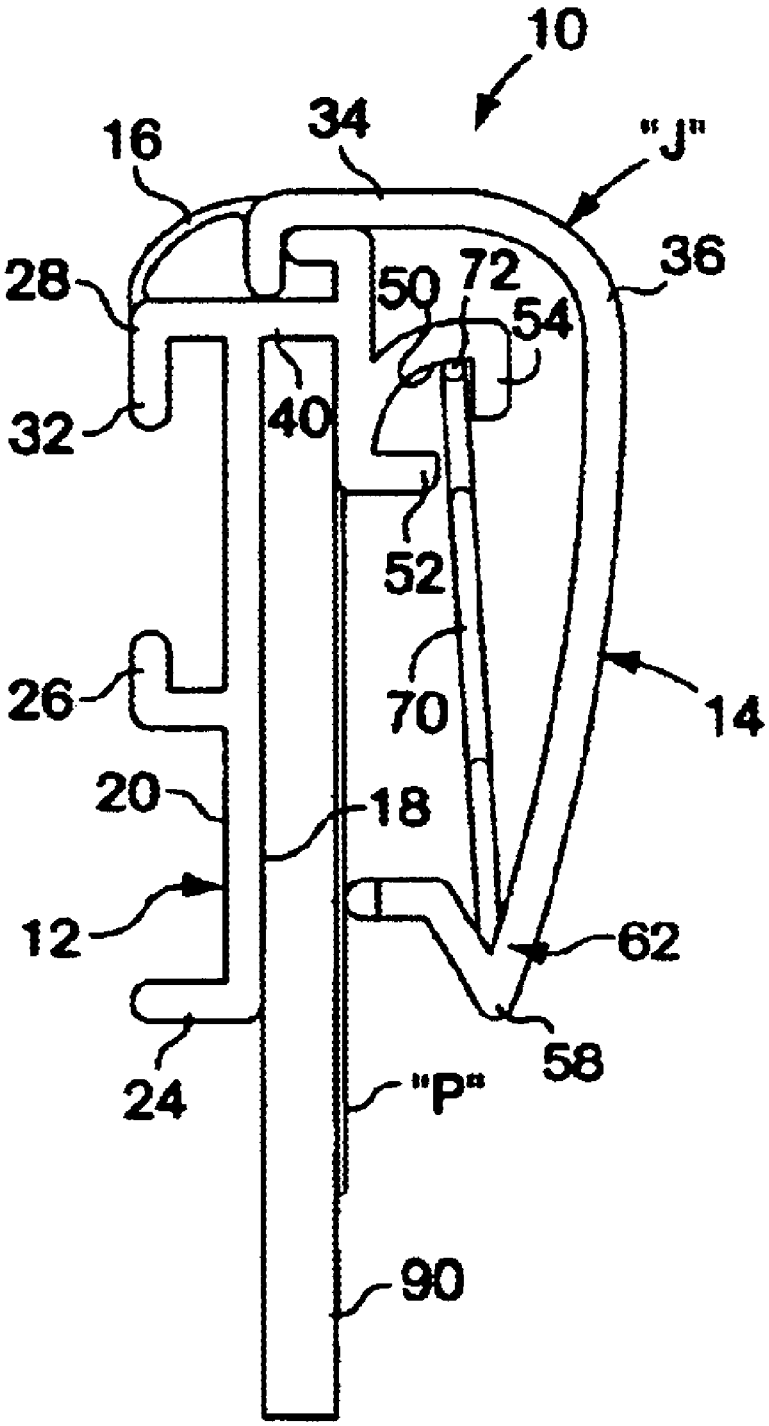
FIG. 4 is an end view of the gripping assembly shown in FIG. 3 in a closed configuration.

One or more elongated, generally sinusoidally-shaped or "zig-zag" wire-like springs 70 are disposed between the elongated back panel 12 and the elongated front cover panel 14, only one spring 70 being shown in the short segment of the gripper extrusion 10. The contours of the spring 70 provides stability and ease of insertion into the channels. The elongated springs 70 each have end portions which are generally parallel with one another. A first end portion 72 of the elongated spring 70 may be inserted within the generally "C"-shaped receiving channel 50 facing forwardly from the elongated back panel 18, as best shown in FIGS. 1, 3 and 4. The elongated spring 70 has a second end 74 which may mate within the "V"-shaped channel 62 formed at the rearward side of the distal end 58 of the front cover panel 14.

Figure 6:
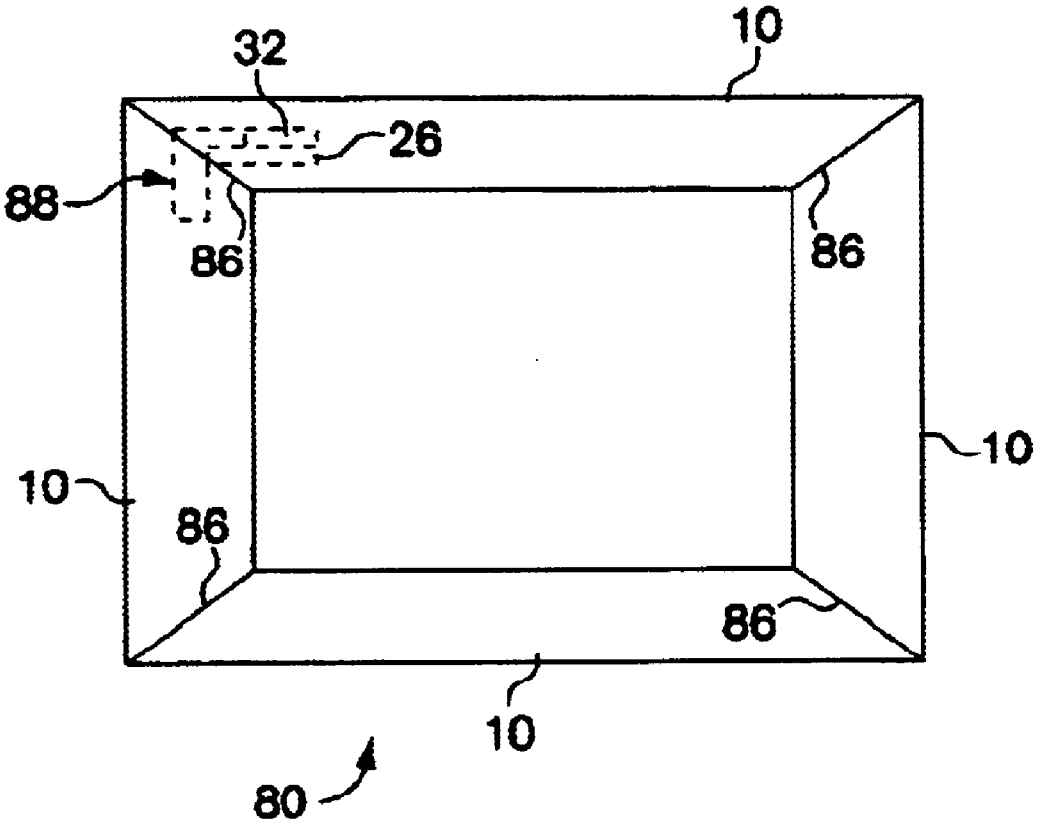
FIG. 6 is a plan view of a frame apparatus constructed from the gripper assemblies shown hereinabove.

In the fabrication of a frame assembly 80 from four elongated gripper extrusions 10, each end 86 thereof would be mitered into a 45 degree cut, as may be seen in FIG. 6. Each mitered end 86 would be then mated with a correspondingly mitered end 86 of a further elongated gripper extrusion 10 and connected therewith by an "L"-shaped bracket 88 disposed at the juncture thereof, and lodged between the upwardly directed middle flange 26 and the downwardly directed lip 32 of the upper flange 28.

Figure 5:
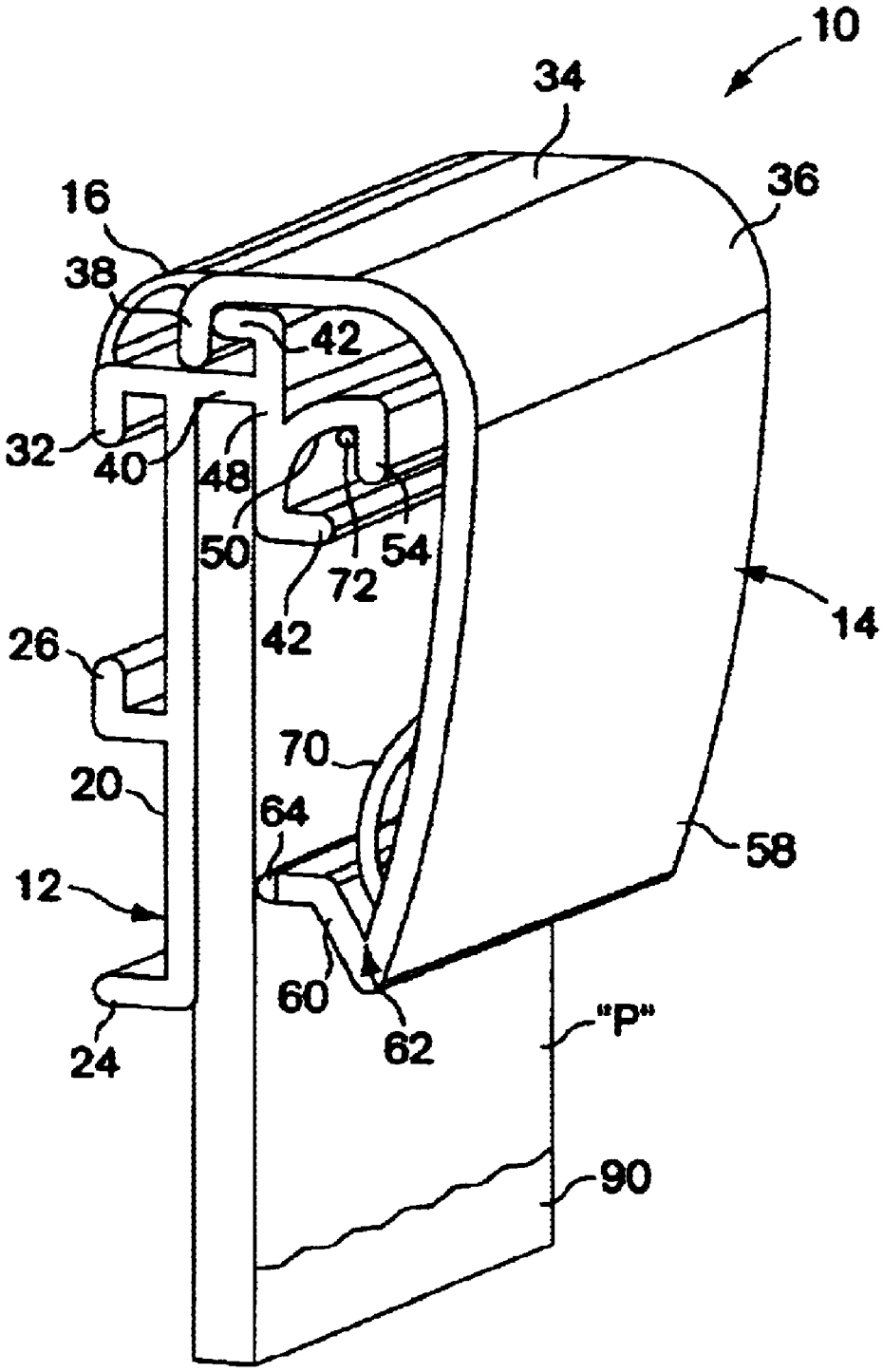
FIG. 5 is a perspective view of the assembly shown in FIG. 4.

A backer board 90 may be inserted within the display receiving channel 92 adjacent the uppermost edge of the forward face of each elongated back panel, as shown in FIGS. 3, 4 and 5. A flexible poster "P" may be disposed atop the backer board 90 and the front cover panel 14 pivoted downwardly as indicated by the arrow "A" in FIG. 1, about the support flange 42, so that the spring 70 biases the front cover panel 14 and its distalmost foot 58 therefrom, against the front surface 18 and the poster "P" on that backer board 90.

Thus has been shown a unique co-extruded poster gripping arrangement which may be assembled into a frame or utilized singularly to display a poster in a biasedly adjustable, efficient and cost effective manner.

We claim:

1. A multiple component gripper extrusion for the gripping support of a poster display arrangement, comprising:

an elongated extruded back panel having a front face, a back face, a lower edge and an upper edge;

an elongated extruded front panel with a panel leg at a proximal portion thereof and a channel at a distal edge thereof, said back panel and said front panel being integrally connected by a living hinge co-extruded simultaneously therewith, wherein said panel leg has a proximal lip extending therefrom, said proximal lip arranged to engage and pivot about a support flange arranged adjacent said upper edge of said back panel, for securement of said front panel onto said back panel when said front panel is biased against said front panel;

an insertable, adjustably disposed elongated spring arranged between said back panel and said distal edge of said front panel to permit controllable biasing of a poster supported on said back panel by said front panel; and an elongated "C" shaped channel arranged on a flange extending off of said front face of said back panel, to provide a long slot for said spring to be adjustably disposed therein.

2. The multiple component gripper extrusion as recited in claim 1, including an upper flange and a middle flange arranged on said back face of said back panel to permit a plurality of said gripper extrusions to be readily joined together by a bracket mated between corresponding upper and middle flanges of adjacent gripper extrusions.

3. The multiple component gripper extrusion as recited in claim 1, wherein said channel at said distal edge of said front panel is of "V" shape in cross-section, with a linear edge attached thereto, comprising a distal foot for pressing against a poster place upon said back panel.

4. The multiple component gripper extrusion as recited in claim 1, wherein said spring is formed from a wire.

5. The multiple component gripper extrusion as recited in claim 4, wherein said wire of said spring is shaped into a sinusoidal configuration.

6. The multiple component gripper extrusion as recited in claim 5, wherein said spring has a first end and a second end, said first end and said second end being generally parallel to one another to permit their ready emplacement in said back panel and said front panel.

7. The multiple component gripper extrusion as recited in claim 3, wherein said linear edge comprising said distal foot pressing against said back panel when said front panel is biased against a poster on said back panel permits said distal edge to be spaced-apart from said poster to permit said distal edge to be readily lifted away from said poster to permit changing thereof.

8. A multiple component gripper extrusion for the gripping support of a poster display arrangement, comprising:

an elongated extruded back panel having a front face, a back face, a lower edge and an upper edge;

an elongated extruded front panel with a panel leg at a proximal portion thereof and a channel at a distal edge thereof, said back panel and said front panel being integrally connected by a living hinge co-extruded simultaneously therewith;

an elongated spring is adjustably disposed between said back panel and said distal edge of said front panel to permit controllable biasing of a poster supported on said back panel by said front panel; wherein an upper flange and a middle flange are arranged on said back face of said back panel to permit a plurality of said gripper extrusions to be readily joined together by a bracket mated between corresponding upper and middle flanges of adjacent gripper extrusions; with an elongated "C" shaped channel arranged on a flange extending off of said front face of said back panel, to provide a long slot for said spring to be adjustably disposed therein; wherein said channel at said distal edge of said front panel is of "V" shape in cross-section, with a linear edge attached thereto, comprising a distal foot for pressing against a poster place upon said back panel; said panel leg having a proximal lip extending therefrom, said proximal lip arranged to engage and pivot about a support flange arranged adjacent said upper edge of said back panel, for securement of said front panel onto said back panel when said front panel is biased against said front panel; and wherein said spring is formed from a wire.

* * * * *